US005135446A

United States Patent [19]

Cooley

[11] Patent Number: 5,135,446

[45] Date of Patent: Aug. 4, 1992

[54] TRAINING AID FOR SKATING

[76] Inventor: John R. Cooley, 2422 Kensington Dr., Kalamazoo, Mich. 49008

[21] Appl. No.: 671,345

[22] Filed: Mar. 19, 1991

[51] Int. Cl.[5] ..... A63B 71/12

[52] U.S. Cl. ..... 482/51; 482/88; 2/92; 2/2

[58] Field of Search ..... 272/70, 93, 1 R; 5/431, 5/434, 436, 441, 443; 2/92, 411

[56] References Cited

U.S. PATENT DOCUMENTS

| | | | |
|---|---|---|---|
| 811,167 | 1/1906 | Paddock | 2/92 |
| 3,550,159 | 12/1970 | Alarco | 2/2 |
| 4,471,993 | 9/1984 | Watson | 5/432 |
| 4,970,742 | 11/1990 | Keener | 5/431 |

*Primary Examiner*—Stephen R. Crow
*Attorney, Agent, or Firm*—Flynn, Thiel, Boutell & Tanis

[57] ABSTRACT

A training aid for skaters includes an enlarged block made from a soft resilient material and including an elongated exterior wall which has an upwardly facing exterior surface. An arrangement is provided for permitting removable support of the block on the skater's torso with the exterior wall projecting from the skater's neck below and significantly forwardly beyond the skater's chin with the exterior surface positioned closely adjacent and below the skater's chin. The resilient block is made from a material which is sufficiently opaque to obstruct normal vision therethrough, thereby obstructing the skater's vision of his skates and a portion of the ice immediately forwardly thereof.

8 Claims, 1 Drawing Sheet

TRAINING AID FOR SKATING

FIELD OF THE INVENTION

The present invention relates generally to a training aid for skaters and, more particularly, to a training aid which can be worn by the skater and positioned to generally resist forwardly downward tilting of the head and to block the skater's view of a portion of the ice immediately in front of the skater.

BACKGROUND OF THE INVENTION

In many sports and activities in which participants move about on foot, it is usually important for the participant (or player) to keep his or her head in a generally upright orientation. With the head generally upright, the player is usually able to play the game more effectively and safely. For example, in fast-paced sports with large numbers of players, it is often important to maintain an awareness of the often rapidly changing positions of other players. By keeping the head upright, each player is able to effectively maximize his or her field of vision and therefore is able to visually monitor the activities of the other players. Hockey, football and basketball are well known examples of such fast-paced sports. For example, hockey players must be able to control the puck with the stick without constantly looking down at the puck.

Safety considerations also often dictate that a player's head be maintained in a generally upright position. For example, in contact sports such as hockey, violent collisions are quite common. Of course, if the head is maintained upright as discussed above, many of these collisions can be avoided altogether, and avoidance of such collisions is often strategically desirable.

It is also often important to maintain the head generally upright when participating in individual sports. For example, in performance sports such as figure skating, the skater must always be aware of his or her position on the ice in order to facilitate proper execution of the skating routine and to avoid contact with the walls of the skating rink.

In view of the foregoing, the importance of keeping the head up cannot be over-emphasized. This is particularly true when teaching young participants the fundamentals of the sport. In hockey, the participant is often only a novice skater when learning the sport, and hence will tend to drop his or her head downwardly in an effort to maximize concentration on both skating and puck control.

Accordingly, the present invention has been developed to help train novice skaters to keep their heads up and to eliminate undesirable head-dropping habits in experienced skaters.

The present invention can be worn by the skater and positioned so as to tend to resist any dropping of the skater's head while also blocking the skater's vision of a portion of the ice immediately in front of the skater. The invention includes an enlarged soft and resilient block which is sufficiently opaque to block normal vision therethrough in at least one direction, and a harness arrangement for permitting removable support of the block on the skater, such that the block projects from the skater significantly forwardly beyond the skater's chin and in closely underlying relationship relative to the chin.

BRIEF DESCRIPTION OF THE DRAWINGS

A preferred embodiment of the present invention is described hereinafter with reference to the enclosed drawing, in which.

DETAILED DESCRIPTION

Figure 1:
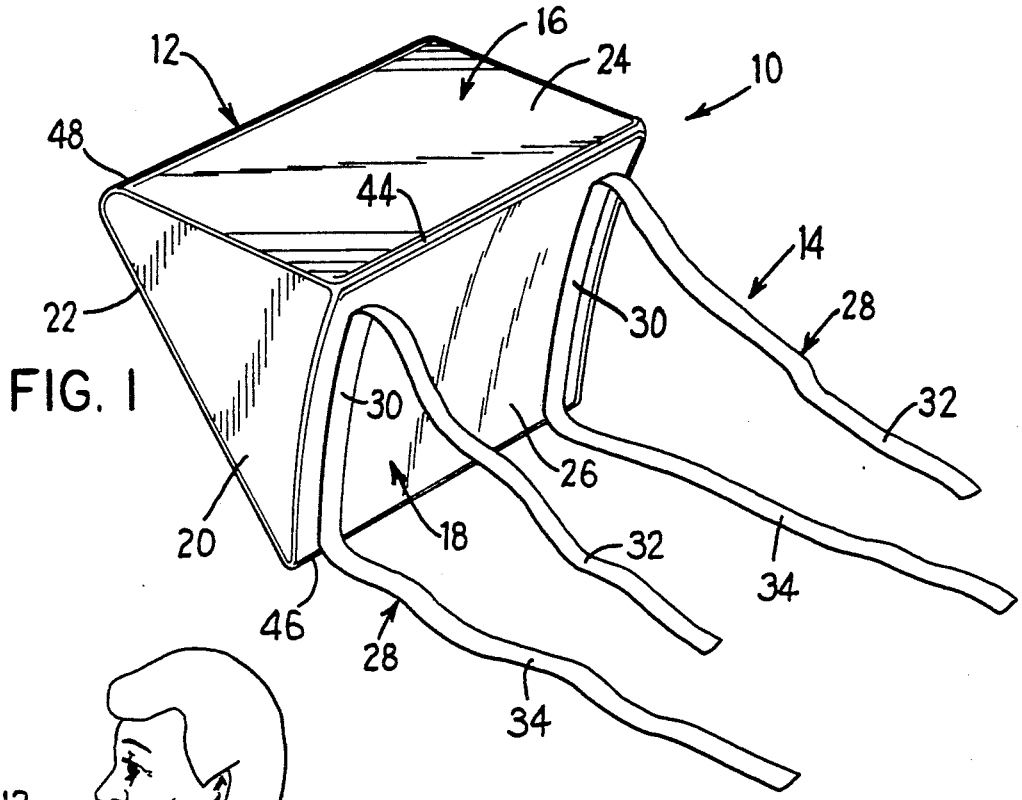
FIG. 1 is a perspective view of a training aid embodying the present invention.

Referring to FIG. 1, the training aid 10 of the present invention includes an enlarged block of soft resilient foam 12, such as a closed cell plastic foam, and a harness 14 attached to the resilient foam block 12. The foam block 12 is preferably constructed similarly to conventional resilient foam pads which are used extensively in athletics.

The block 12 has a generally triangular vertical cross section defined between exterior walls 16, 18 and 22. The block 12 also includes laterally facing exterior walls 20 on opposite lateral sides thereof. The vertical cross section of the block 12 (and hence each wall 20) approximately defines a right triangle, with the wall 22 defining the hypotenuse thereof. The walls 16 and 18 define respective outwardly facing upper and rear exterior surfaces 24 and 26 which are approximately perpendicular to each other. However, the surface 26 preferably has a slightly inwardly concave configuration for reasons discussed below. The walls 16 and 18 adjoin each other to define an elongate edge 44, the walls 16 and 22 adjoin each other to define another elongate edge 48, and the walls 22 and 18 adjoin each other to define a third elongate edge 46. These elongate edges 44, 46 and 48 are approximately parallel to one another and preferably define rounded corners.

The harness 14 includes a pair of harness straps 28 secured to the concave surface 26 of exterior wall 18. Each strap 28 includes a central portion 30 which is secured to the wall 18 by any suitable conventional means such as adhesive bonding or sewing. The central portions 30 are located adjacent the lateral walls 20 and extend parallel to each other and perpendicular to the elongate edges 44, 46 and 48. Upper end strap parts 32 and lower end strap parts 34 extend freely away from opposite ends of the central strap portions 30.

Figure 2:
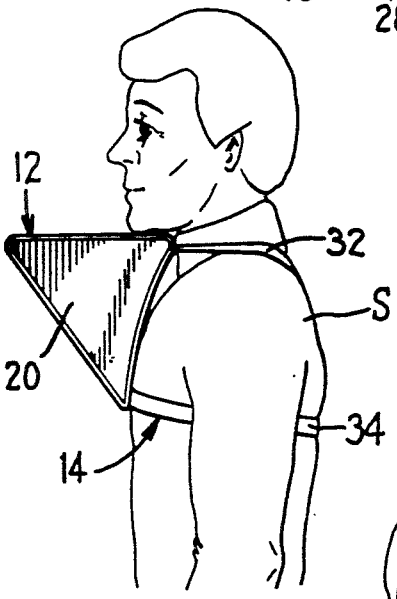
FIG. 2 is a side elevational view of the training aid of FIG. 1 as worn by a skater.
Figure 4:
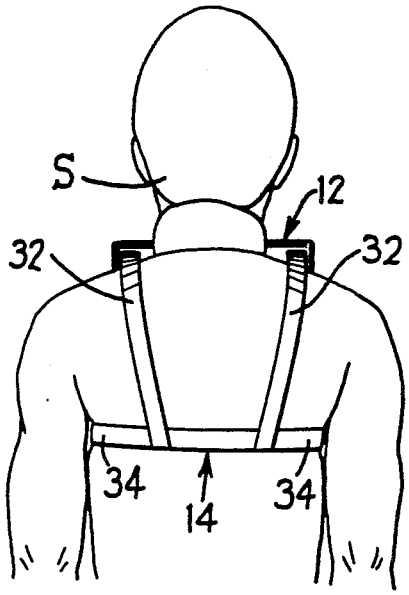
FIG. 4 is a rear elevational view of a skater wearing the training aid of FIG. 1.
Figure 3:
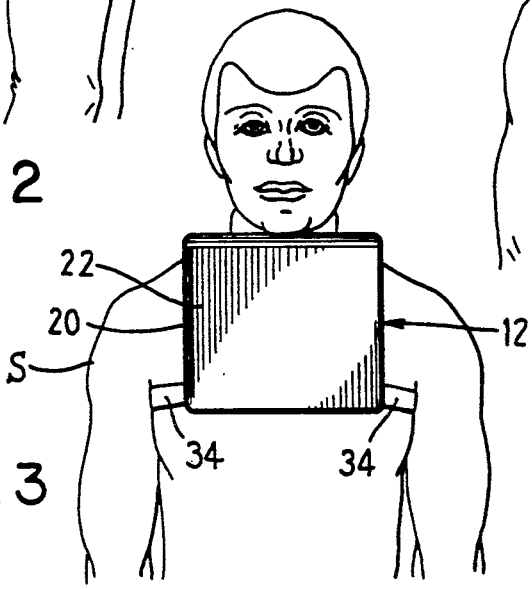
FIG. 3 is a front elevational view showing a skater wearing the training aid of FIG. 1.

Referring to FIGS. 2–4, the block 12 is worn by a skater S by means of the harness 14. With the concave surface 26 of the exterior wall 18 resting against the upper torso or chest of the skater S, the upper end strap parts 32 are drawn rearwardly over the skater's shoulders, and the lower end strap parts 34 are wrapped rearwardly around the skater's torso. The upper and lower end strap parts are provided with suitable conventional fastening means, such as Velcro, to permit fastening of the harness 14 as shown in FIG. 4. More specifically, the lower end strap parts 34 are releasably fastened together behind the skater's torso, and the upper end strap parts 32 are releasably fastened to the lower end strap parts 34. In the preferred embodiment of the present invention, Velcro is used to fasten the lower end strap parts 34 together and to fasten the upper end strap parts 32 to the lower end strap parts. However, it is evident from FIG. 4 that numerous conventional arrangements could be used to perform the required releasable fastening of the harness 14 so as to permit the block 12 to be worn by the skater S. For example, the upper end strap parts 32 could be provided with loops through which the lower end strap parts 34 would pass, and the lower end strap parts 34 could be fastened together using a buckle.

With the harness 14 fastened securely on the upper torso of the skater S, the concave surface 26 of exterior wall 18 seats relatively flush against the front of the skater's upper torso. The exterior surface 24 of the upper exterior wall 16 is disposed closely beneath the skater's chin such that the chin can effectively rest on the block 12. The upper wall 16 projects forwardly from the neck beyond the chin by approximately 8 to 10 inches in the preferred embodiment. However, this distance is obviously easily variable by varying the size of the block 12.

When positioned as described above, the block 12 is held securely upon the chest of the skater S directly under the chin. Thus, the chin can effectively rest on the upper surface 24 of the block 12, and the block 12 thereby yieldably resists forwardly downward tilting movement of the skater's head. Consequently, the skater is forced to keep his head upright.

In addition, the block 12 is preferably made from an opaque material which blocks the skater's vision therethrough. Therefore, because the block 12 extends forwardly beyond the skater's chin by a significant amount, and also preferably has a width which is at least equal to and is preferably greater than the width of the skater's head, the block 12 thus obstructs the skater's vision of the ice immediately below and in front of him. This prevents the skater from glancing or looking at his skates or the ice immediately forwardly thereof. This is important because repeated and extended glances at the skates or the puck will tend to cause the skater to actually tilt his head forwardly and downwardly, even though the skater may not be conscious of such head tilting. Of course, the size of the visual range which is obstructed depends on the size of the block 12 and the amount by which it extends forwardly and sidewardly beyond the chin.

Because the block 12 is made from a soft and resilient foam or rubberlike material, it will also aid in breaking falls and protecting the skater's face should he fall forwardly onto the ice.

It will be appreciated that the structure for releasably securing the block to the skater may assume many other configurations and arrangements. It will also be appreciated that the foam block can be suitably covered by a flexible fabric or other suitable covering material.

Although a particular preferred embodiment of the invention has been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. A training aid for a skater, comprising:

an enlarged block made of a soft and resilient material, said block being substantially triangular in vertical cross section and having first, second and third exterior walls, said first exterior wall being upright and having upper and lower ends, said first exterior wall being shaped so that the lower portion of said first exterior wall is adapted to rest on the chest of the skater and the upper end of said first exterior wall is adapted to be received directly under and close to the chin of the skater, said second exterior wall having inner and outer ends, said inner end of said second exterior wall being joined to the upper end of said first exterior wall, said second exterior wall extending approximately horizontally and approximately perpendicular to said first exterior wall, the inner portion of said second exterior wall being adapted to closely underlie the chin of the skater and function as a chin rest for maintaining the head of the skater in an upright position, the remainder of said second exterior wall being horizontally elongated and adapted to extend forwardly from the skater's body a substantial distance effective to block the skater from viewing the ice directly in front of the skater's body; and a harness for removably supporting said block on the skater's body so that said second wall is positioned so as to closely underline the skater's chin.

2. A training aid according to claim 1, wherein said remainder of said second exterior wall projects forwardly from said inner portion a distance at least about as large as the front-to-back thickness of a human head, and said harness for permitting removable support of said block includes elongated strap means attached to said first exterior wall.

3. A training aid according to claim 2, wherein said elongated strap means includes a central strap portion and two end strap portions, said central strap portion having opposite ends and being secured to said first exterior wall, and said end strap portions extending from said opposite ends of said central strap portion and terminating in respective free ends.

4. A training aid according to claim 3, wherein said harness includes a pair of said elongated strap means, said first and second exterior walls of said block defining therebetween an elongate edge of said block and said central strap portions being arranged on said first exterior wall in generally parallel relationship to each other and in generally perpendicular relationship to said elongate edge of said block.

5. A training aid according to claim 4, wherein said elongate edge of said block terminates in opposite ends, said central strap portions being located adjacent respective said opposite ends of said elongate edge.

6. A training aid according to claim 1, wherein said first exterior wall is slightly concave from top to bottom to permit flush seating of said block on the skater's chest.

7. A training aid for a skater, comprising:

an enlarged block made of a soft and resilient material, said block having first and second exterior walls, said first exterior wall being upright and having upper and lower ends, said first exterior wall being shaped so that the lower portion of said first exterior wall is adapted to rest on the chest of the skater and the upper end of said first exterior wall is adapted to be received directly under and close to the chin of the skater, said second exterior wall having inner and outer ends, said inner end of said second exterior wall being joined to the upper end of said first exterior wall, said second exterior wall extending approximately and approximately perpendicular to said first exterior wall, the inner portion of said second exterior wall being adapted to closely underlie the chin of the skater and function as a chin rest for maintaining the head of the skater in an upright position, the remainder of said second exterior wall being horizontally elongated and adapted to extend forwardly from the skater's body a substantial distance beyond the skater's chin for effectively blocking the skater's view of the ice directly in front of the skater's body; and harness means attached to the block for removably supporting said block on the skater's body so that said first wall abuts an upper portion of the skater's chest and said second wall is positioned to closely underline the skater's chin and is contacted by the chin if the skater's head is tilted downwardly.

8. A training aid according to claim 7, wherein said block is of a soft and resilient form, and said second wall is of a substantial extent as measured between the inner and outer ends thereof so as to project forwardly beyond the skater's chin by at least about 8 inches.

* * * * *

UNITED STATES PATENT AND TRADEMARK OFFICE

CERTIFICATE OF CORRECTION

PATENT NO. : 5 135 446

DATED : August 4, 1992

INVENTOR(S) : John R. Cooley

It is certified that error appears in the above-identified patent and that said Letters Patent is hereby corrected as shown below:

Column 4, line 39; after "block" insert ---,---.

Column 4, line 65; after "extending approximately" insert ---horizontally---.

Signed and Sealed this

Fourteenth Day of September, 1993

Bruce Lehman

*Attest:*

BRUCE LEHMAN

*Attesting Officer*

*Commissioner of Patents and Trademarks*